US007651187B2

(12) United States Patent
Nishimura

(10) Patent No.: US 7,651,187 B2
(45) Date of Patent: Jan. 26, 2010

(54) INKJET RECORDER

(75) Inventor: Asayo Nishimura, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 229 days.

(21) Appl. No.: 11/979,312

(22) Filed: Nov. 1, 2007

(65) Prior Publication Data

US 2008/0106567 A1 May 8, 2008

(30) Foreign Application Priority Data

Nov. 6, 2006 (JP) ..... 2006-300534

(51) Int. Cl.
*B41J 29/38* (2006.01)

(52) U.S. Cl. ..... 347/14; 347/16; 347/17

(58) Field of Classification Search ..... 347/9, 347/12, 14, 16, 17, 19
See application file for complete search history.

(56) References Cited

U.S. PATENT DOCUMENTS 6,517,175 B2 * 2/2003 Kanaya et al. ..... 347/7
6,775,022 B2 * 8/2004 Noyes et al. ..... 358/1.15

* cited by examiner

*Primary Examiner*—Thinh H Nguyen
(74) *Attorney, Agent, or Firm*—Manabu Kanesaka

(57) ABSTRACT

A line-type inkjet recorder for printing a desired image onto paper by discharging ink from plural nozzles provided in a head part, the inkjet recorder includes: an image data processing part for converting image data to be printed into print data for each of the nozzles; a temperature detection part for detecting a temperature of the head part and outputting head temperature information based on the detected temperature; and a head control part for, based on states of a continuous non-discharge nozzle and a continuous discharge nozzle adjacent thereto included in the nozzles and extracted based on the head temperature information from the temperature detection part and the print data from the image data processing part, controlling frequencies of idle discharge from the continuous non-discharge nozzle and continuous discharge nozzle extracted.

1 Claim, 8 Drawing Sheets

Fig.7

| PRINT MODE | PAPER TYPE | CONVEYANCE SPEED | PAPER SIZE | HEAD PASSAGE TIME | CONTINUOUS PRINT COPY QUANTITY | CONTINUOUS PRINT TIME | OVERALL FREQUENCY OF IDLE DISCHARGE [ONCE/LINE] ( ) FOR 35°C OR MORE | FREQUENCY OF IDLE DISCHARGE FROM EXTRACTED NOZZLE (= DETERMINED NUMBER OF LINES FOR EXTRACTED NOZZLE) [ONCE/LINE] ( ) FOR 35°C OR MORE |
|---|---|---|---|---|---|---|---|---|
| NORMAL MODE | IJ PAPER | 400mm/s | A3 (VERTICAL) | 1.05S | 1~57 | LESS THAN 1 MINUTES | 2000(2000) | 1000(800) |
| | | | | | 58~285 | 1 TO 5 MINUTES | 1500(1000) | 800(500) |
| | | | | | 286~571 | 5 TO 10 MINUTES | 1000(700) | 500(100) |
| | | | A4 (VERTICAL) | 0.735S | 1~81 | LESS THAN 1 MINUTES | 2000(2000) | 1000(800) |
| | | | | | 82~408 | 1 TO 5 MINUTES | 1500(1000) | 800(500) |
| | | | | | 409~816 | 5 TO 10 MINUTES | 1000(700) | 500(100) |
| | | | A4 (HORIZONTAL) | 0.525S | 1~114 | LESS THAN 1 MINUTES | 2000(2000) | 1000(800) |
| | | | | | 115~571 | 1 TO 5 MINUTES | 1500(1000) | 800(500) |
| | | | | | 572~1142 | 5 TO 10 MINUTES | 1000(700) | 500(100) |
| | STANDARD PAPER | 600mm/s | A3 (VERTICAL) | 0.7S | 1~86 | LESS THAN 1 MINUTES | 2000(2000) | 1000(800) |
| | | | | | 87~428 | 1 TO 5 MINUTES | 1500(1000) | 800(500) |
| | | | | | 429~861 | 5 TO 10 MINUTES | 1000(700) | 500(100) |
| | | | A4 (VERTICAL) | 0.49S | 1~122 | LESS THAN 1 MINUTES | 2000(2000) | 1000(800) |
| | | | | | 123~612 | 1 TO 5 MINUTES | 1500(1000) | 800(500) |
| | | | | | 613~1224 | 5 TO 10 MINUTES | 1000(700) | 500(100) |
| | | | A4 (HORIZONTAL) | 0.35S | 1~171 | LESS THAN 1 MINUTES | 2000(2000) | 1000(800) |
| | | | | | 172~857 | 1 TO 5 MINUTES | 1500(1000) | 800(500) |
| | | | | | 858~1711 | 5 TO 10 MINUTES | 1000(700) | 500(100) |

Fig.8

| PRINT MODE | PAPER TYPE | CONVEYANCE SPEED | PAPER SIZE | HEAD PASSAGE TIME | CONTINUOUS PRINT COPY QUANTITY | CONTINUOUS PRINT TIME | OVERALL FREQUENCY OF IDLE DISCHARGE [ONCE/LINE] ( ) FOR 35°C OR MORE | FREQUENCY OF IDLE DISCHARGE FROM EXTRACTED NOZZLE (= DETERMINED NUMBER OF LINES FOR EXTRACTED NOZZLE) [ONCE/LINE] ( ) FOR 35°C OR MORE |
|---|---|---|---|---|---|---|---|---|
| HIGH-DEFINITION MODE | IJ PAPER | 200mm/s | A3 (VERTICAL) | 2.1S | 1~28 | LESS THAN 1 MINUTES | 2000(2000) | 1000(800) |
| | | | | | 29~142 | 1 TO 5 MINUTES | 1500(1000) | 800(500) |
| | | | | | 143~281 | 5 TO 10 MINUTES | 1000(700) | 500(100) |
| | | | A4 (VERTICAL) | 1.47S | 1~40 | LESS THAN 1 MINUTES | 2000(2000) | 1000(800) |
| | | | | | 41~204 | 1 TO 5 MINUTES | 1500(1000) | 800(500) |
| | | | | | 205~401 | 5 TO 10 MINUTES | 1000(700) | 500(100) |
| | | | A4 (HORIZONTAL) | 1.05S | 1~57 | LESS THAN 1 MINUTES | 2000(2000) | 1000(800) |
| | | | | | 58~285 | 1 TO 5 MINUTES | 1500(1000) | 800(500) |
| | | | | | 286~571 | 5 TO 10 MINUTES | 1000(700) | 500(100) |
| | STANDARD PAPER | 300mm/s | A3 (VERTICAL) | 1.4S | 1~42 | LESS THAN 1 MINUTES | 2000(2000) | 1000(800) |
| | | | | | 43~128 | 1 TO 5 MINUTES | 1500(1000) | 800(500) |
| | | | | | 129~421 | 5 TO 10 MINUTES | 1000(700) | 500(100) |
| | | | A4 (VERTICAL) | 0.98S | 1~61 | LESS THAN 1 MINUTES | 2000(2000) | 1000(800) |
| | | | | | 62~122 | 1 TO 5 MINUTES | 1500(1000) | 800(500) |
| | | | | | 123~611 | 5 TO 10 MINUTES | 1000(700) | 500(100) |
| | | | A4 (HORIZONTAL) | 0.7S | 1~86 | LESS THAN 1 MINUTES | 2000(2000) | 1000(800) |
| | | | | | 87~428 | 1 TO 5 MINUTES | 1500(1000) | 800(500) |
| | | | | | 429~861 | 5 TO 10 MINUTES | 1000(700) | 500(100) |

INKJET RECORDER

BACKGROUND OF THE INVENTION

1. Technical Field of the Invention

The present invention relates to a line-type inkjet recorder, and more specifically to an inkjet recorder that prevents discharge failure accompanying ink quality change occurring in a non-discharge nozzle during printing.

2. Description of the Related Arts

A line-type inkjet driving device is conventionally known which selectively controls ink discharge to form a monochromatic or full-color image on a print recording medium (hereinafter indicated as paper), such as a paper sheet.

The inkjet driving device of this type has a nozzle (hereinafter indicated as non-discharge nozzle) that does not perform discharge even once depending on an image to be printed. This non-discharge nozzle does not discharge ink during printing. For example, if ink is discharged from a nozzle adjacent to the non-discharge nozzle, due to driving of a discharge ink chamber thereof, ink near a discharge port of the non-discharge nozzle may vibrate. After a lapse of long non-discharge time under the condition that the ink near the discharge port of the non-discharge nozzle vibrates as described above, there arises a problem that, as a result of contact of the ink near the discharge port with air, this ink changes in quality and also its drying is promoted, which is likely to cause ink discharge failure and non-discharge.

Thus, to address such a problem, for example, an inkjet recorder disclosed in Patent document 1 is suggested.

An inkjet recording method performed in the inkjet recorder disclosed in Patent Document 1 measures the continuous non-discharge time for each nozzle and discharges non-image ink droplets from each nozzle in a predetermined discharge pattern during print operation to thereby achieve ink droplet discharge maintaining processing without stopping the print operation. This method maintains highly accurate printing by measuring the continuous non-discharge time for each nozzle from print driving data for each nozzle and forcibly discharging ink droplets from each nozzle in a discharge pattern predetermined separately from the print driving data during print operation.

[Patent Document 1] Japanese Patent Application Laid-open No. 2002-178534

However, the inkjet recorder disclosed in Patent Document 1 prevents discharge failure in the continuous non-discharge nozzle by way of so-called "idle discharge" that periodically discharges non-image recording ink droplets from the non-discharge nozzle in a less conspicuous manner. However, this method controls idle discharge by the continuous non-discharge time, so that, when the continuous print time or the continuous non-discharge time is long, ink consumption unnecessarily increases for operations other than printing, which is not economical.

SUMMARY OF THE INVENTION

Thus, in view of the problem described above, the present invention has been made, and it is an object of the invention to provide an inkjet recorder for optimally controlling the frequency of idle discharge in accordance with the continuous non-discharge time and an image pattern.

To address the object described above, a line-type inkjet recorder according to claim 1 for printing a desired image onto paper by discharging ink from plural nozzles provided in a head part includes: an image data processing part for converting image data to be printed into print data for each of the nozzles; a temperature detection part for detecting a temperature of the head part and outputting head temperature information based on the detected temperature; and a head control part for, based on states of a continuous non-discharge nozzle and a continuous discharge nozzle adjacent thereto included in the nozzles and extracted based on the head temperature information from the temperature detection part and the print data from the image data processing part, controlling frequencies of idle discharge from the continuous non-discharge nozzle and continuous discharge nozzle extracted.

A line-type inkjet recorder according to claim 2 for printing a desired image onto paper by discharging ink from plural nozzles provided in a head part includes: an image data processing part for converting image data to be printed into print data for each of the nozzles; an operation part for setting desired printing-related image data to input print condition information; a temperature detection part for detecting a temperature of the head part and outputting head temperature information based on the detected temperature; a paper size detection part for detecting a length of the paper in a sub-scanning direction and outputting detected paper size information based on the detected length of the paper; a conveyance speed calculation part for calculating a conveyance speed of the paper based on the print condition information outputted from the operation part and outputting conveyance speed information based on the calculated conveyance speed; and a head control part for, based on states of a continuous non-discharge nozzle and a continuous discharge nozzle adjacent thereto both included in the nozzles which states are extracted based on the print condition information from the operation part, the paper size information from the paper size detection part, continuous print time information obtained from the conveyance speed information from the conveyance speed calculation part, the head temperature information from the temperature detection part, and the print data from the image data processing part, controlling frequencies of idle discharge from the continuous non-discharge nozzle and continuous discharge nozzle extracted.

With the inkjet recorder of the present invention, a non-discharge nozzle continuously in a non-discharge state and a discharge nozzle adjacent to the non-discharge nozzle are selected based on print condition and a print image during printing, minimum necessary amounts of ink are periodically discharged from these selected non-discharge nozzle and discharge nozzle. Thus, this is effective in preventing discharge failure caused by ink quality change in the non-discharge nozzle and the discharge nozzle and ink drying of their nozzle portions, while controlling unnecessary ink consumption.

BRIEF DESCRIPTION OF THE DRAWINGS

FIG. 7 is a table showing a relationship between continuous print time and the frequency of idle discharge when the inkjet recorder is driven in Example 1; and FIG. 8 is a table showing a relationship between continuous print time and the frequency of idle discharge when the inkjet recorder is driven in Example 2.

DETAILED DESCRIPTION OF THE PREFERRED EMBODIMENTS

Figure 1:
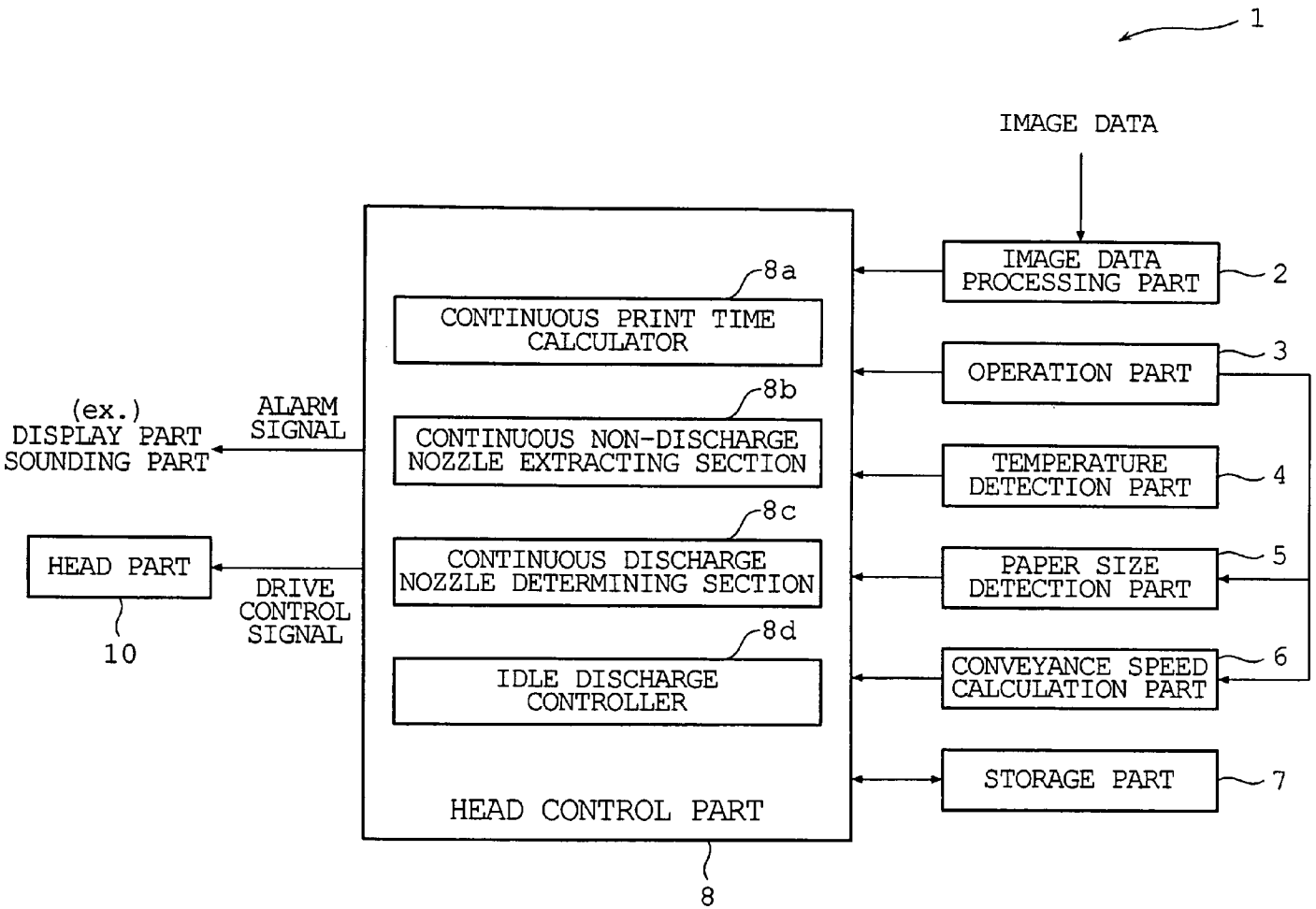
FIG. 1 is a schematic block diagram illustrating configuration of an inkjet recorder according to a first embodiment of the present invention.
Figure 2:
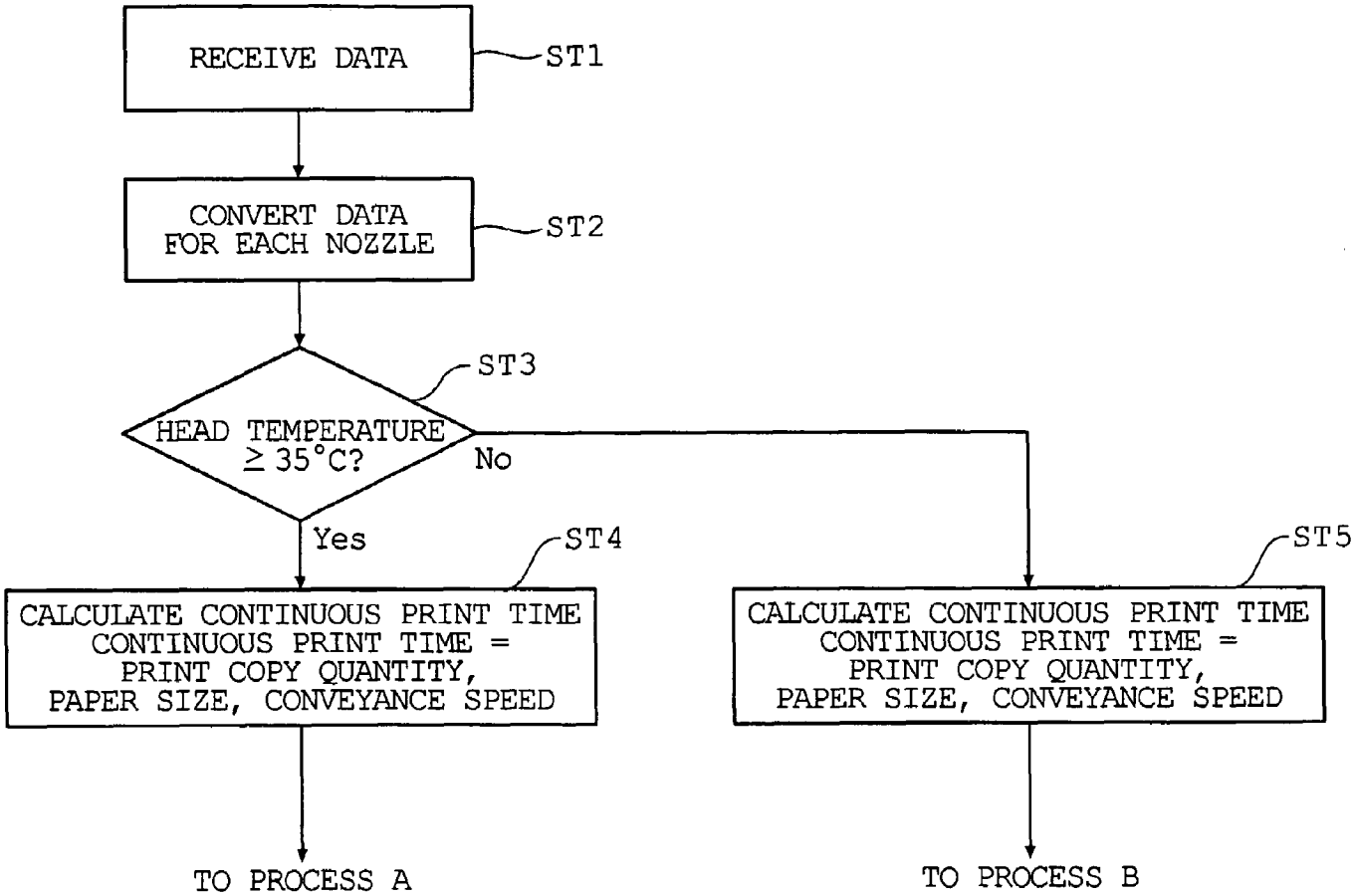
FIG. 2 is a flowchart diagram illustrating processing operation of the inkjet recorder according to the first embodiment of the invention.
Figure 3:
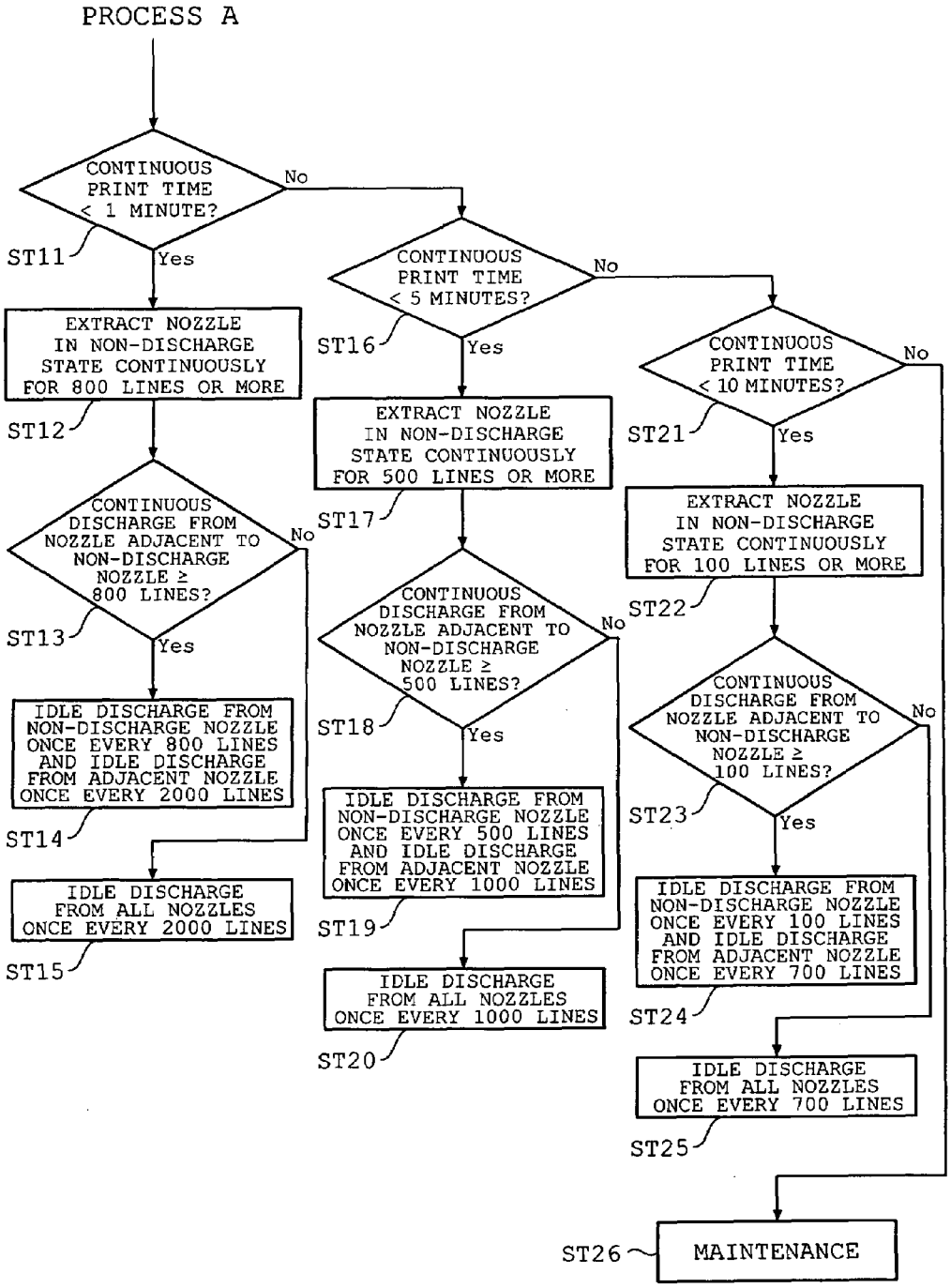
FIG. 3 is a flowchart diagram illustrating processing operation following process A in the processing operation of FIG. 2.
Figure 4:
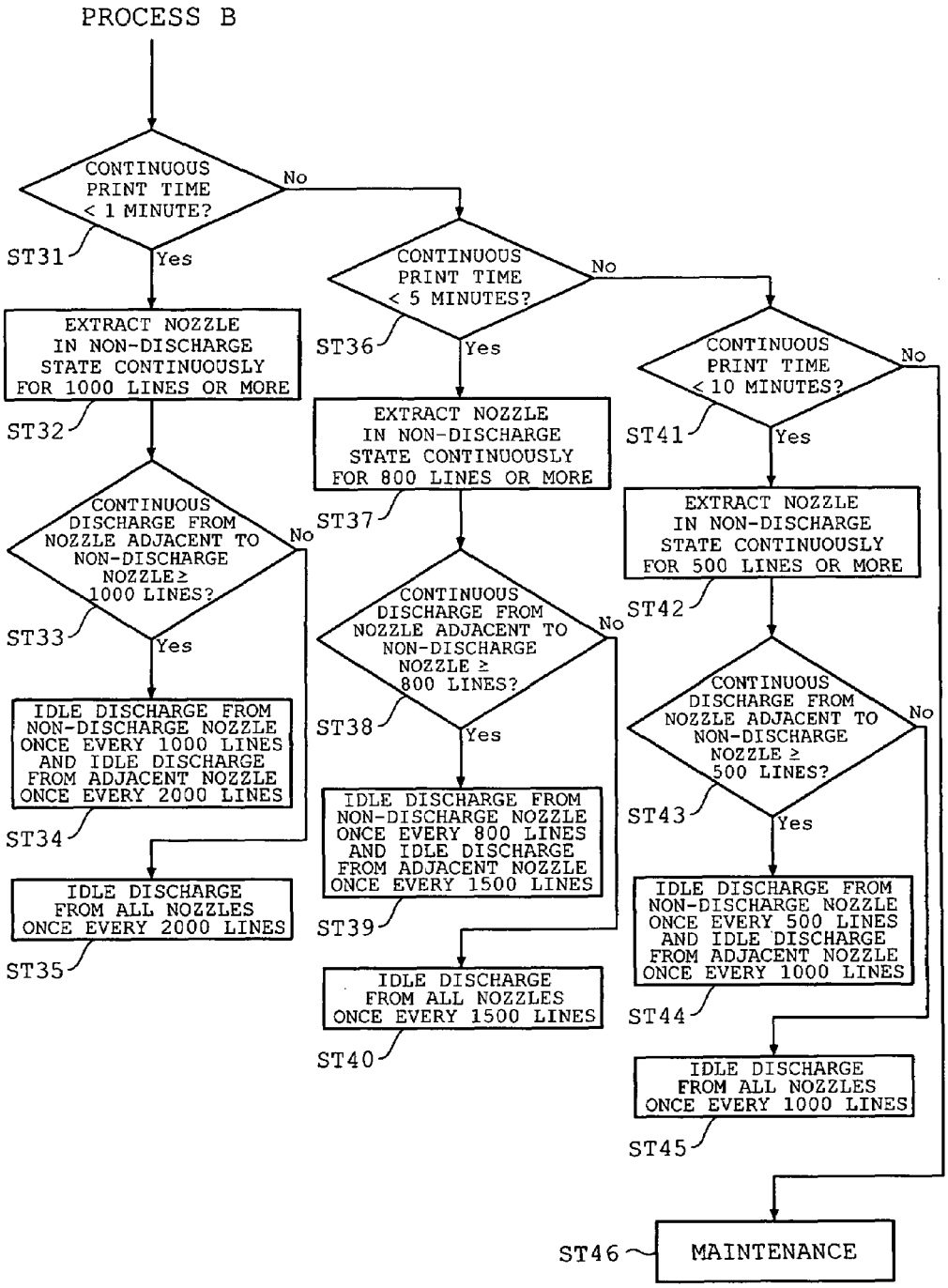
FIG. 4 is a flowchart diagram illustrating processing operation following process B in the processing operation of FIG. 2.
Figure 5:
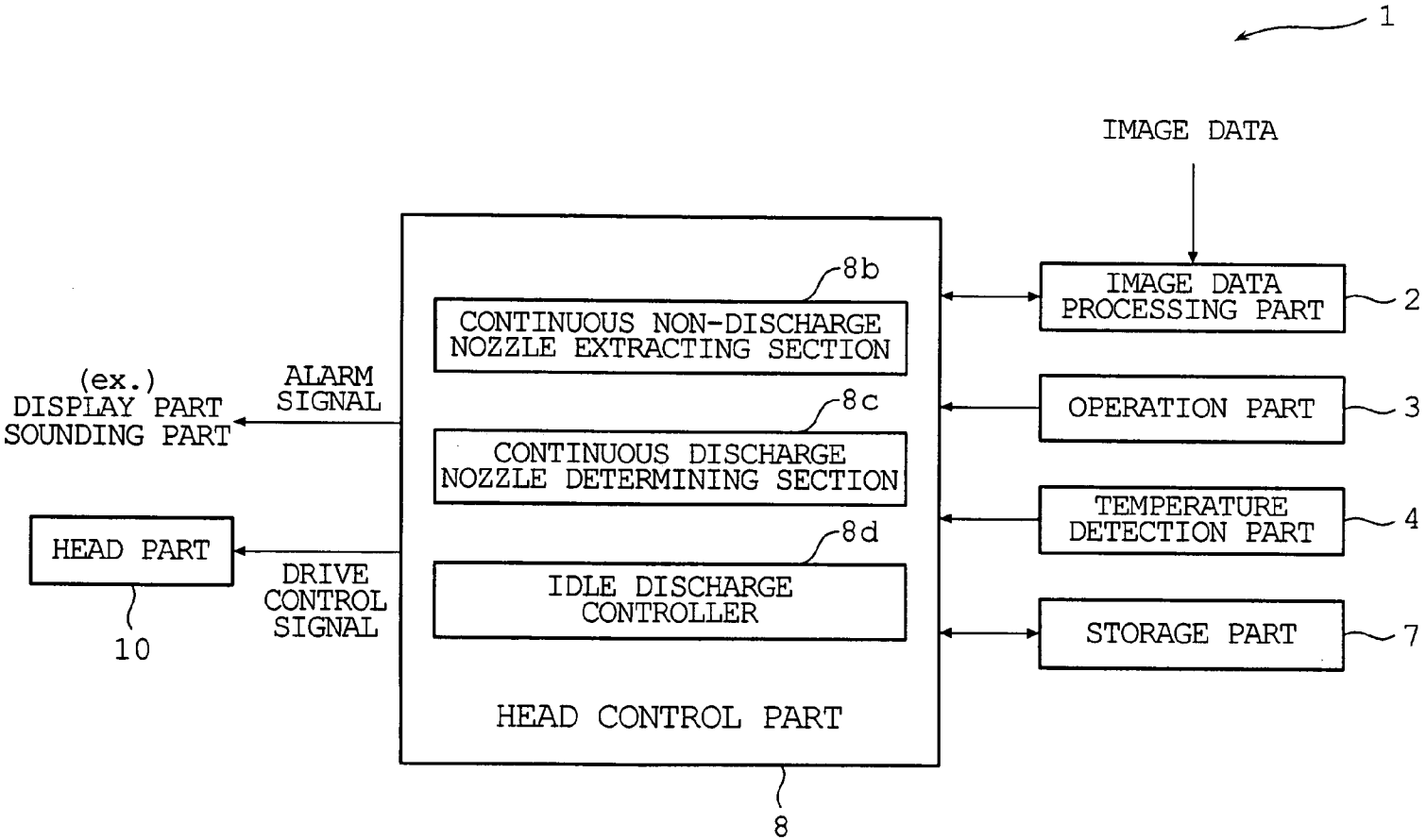
FIG. 5 is a schematic block diagram illustrating configuration of an inkjet recorder according to a second embodiment of the invention.
Figure 6:
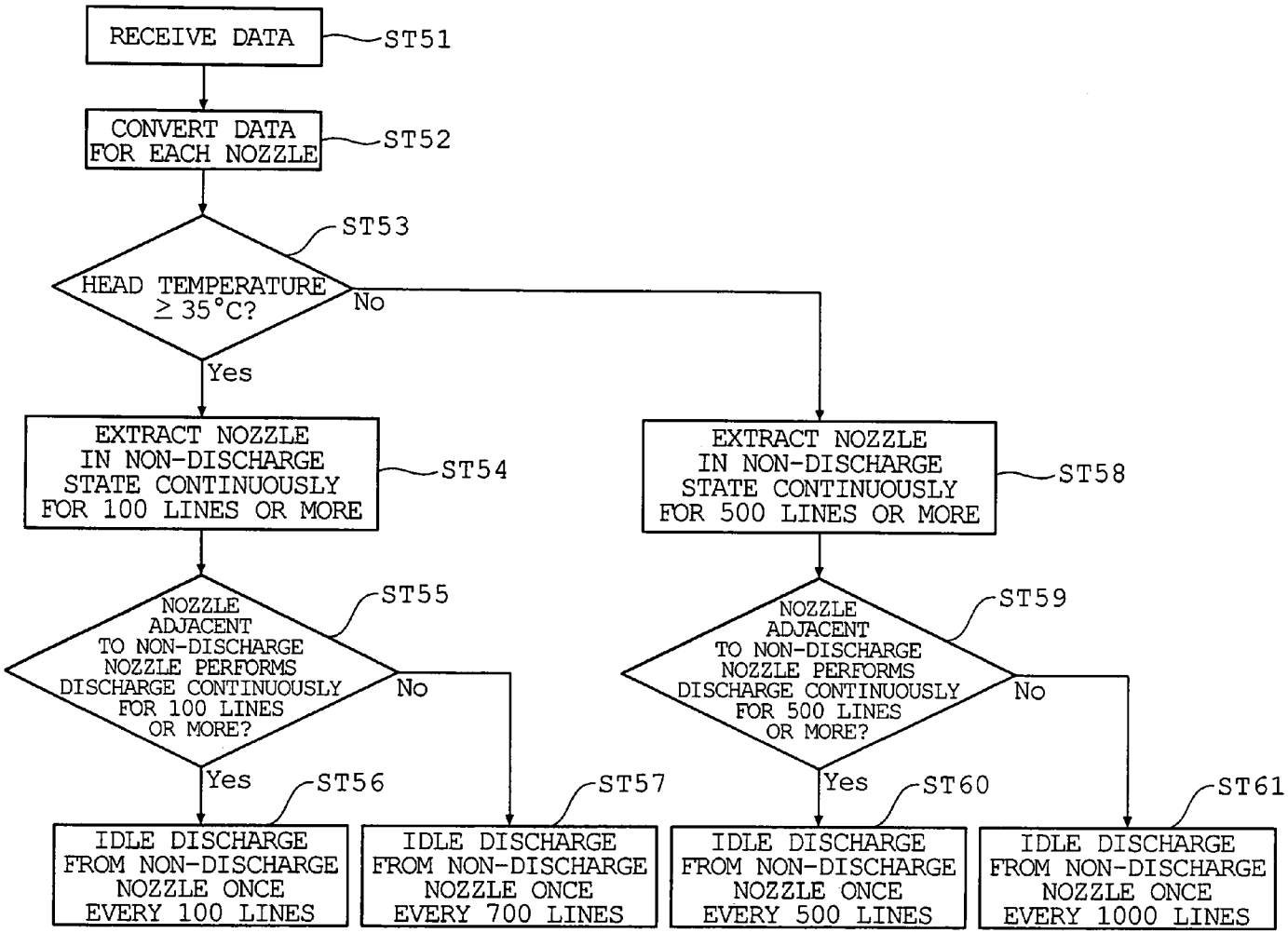
FIG. 6 is a flowchart diagram illustrating processing operation of the inkjet recorder according to the second embodiment of the invention.

Hereinafter, the embodiments of the present invention will be described in detail, with reference to the accompanying drawings. FIG. 1 is a schematic block diagram illustrating configuration of the first embodiment of an inkjet recorder according to the invention. FIG. 2 is a flowchart diagram illustrating processing operation of the inkjet recorder according to the first embodiment of the invention. FIG. 3 is a flowchart diagram illustrating processing operation following process A in the processing operation of FIG. 2. FIG. 4 is a flowchart diagram illustrating processing operation following process B in the processing operation of FIG. 2. FIG. 5 is a schematic block diagram illustrating configuration of the second embodiment of the inkjet recorder according to the invention. FIG. 6 is a flowchart diagram illustrating processing operation of the inkjet recorder according to the second embodiment of the invention.

The inkjet recorder of the invention calculates, from print data, the number of lines for continuous non-discharge from a non-discharge nozzle continuously in a non-discharge state during printing, and the number of lines for continuous discharge from a discharge nozzle adjacent to the non-discharge nozzle, and controls idle discharge from the non-discharge nozzle and the discharge nozzle based on print conditions such as print image data, the print copy quantity, paper size, paper conveyance speed, and head temperature, to prevent nozzle discharge failure.

The inkjet recorder of this example has the same components (for example, a paper feed part, paper conveyance part, and the like) as those of a conventionally well-known line-type inkjet recorder that performs printing by blowing ink against a recording medium, and thus its description will be omitted, while providing a description of only main components of the invention.

As the type of ink used in the inkjet recorder of this example, the following water-based pigment ink can be selected for use under the condition that the viscosity range is 5 to 15 [mpa·s] and the surface tension is 25 to 45 [mN/m].

As a pigment for water-base pigment ink, a well-known colored organic pigment or colored inorganic pigment can be used. Examples of such a pigment include: azo pigments such as azo lake, an insoluble azo pigment, a condensed azo pigment, and a chelate azo pigment; polycyclic pigments such as a phthalocyanine pigment, perylene, a perylene pigment, an anthraquinone pigment, a quinacridone pigment, a dioxanzine pigment, a thioindigo pigment, an iso-indolinone pigment, and a quinophthaloni pigment; dye lake such as basic dye type lake and acid dye type lake; organic pigments such as a nitro pigment, a nitroso pigment, aniline black, and a daylight fluorescent pigment; and inorganic pigments such as carbon black.

As a solvent, a water-soluble organic solvent is used. Examples of such a solvent include: alcohols (for example, methanol, ethanol, propanol, isopropanol, butanol, isobutanol, secondary butanol, tertiary butanol, pentanol, hexanol, cyclohexanol, benzyle alcohol, and the like), polyhydric alcohols (for example, ethylene glycol, diethylene glycol, triethylene glycol, polyethylene glycol, propylene glycol, dipropylene glycol, polypropylene glycol, butylene glycol, hexanediol, pentanediol, glycerine, hexanetriol, thiodiglycol, and the like), polyhydric alcohol ethers (for example, ethylene glycol monomethyl ether, ethylene glycol monoethyl ether, ethylene glycol monobutyl ether, ethylene glycol monophenyl ether, diethylene glycol monomethyl ether, diethylene glycol monoethyl ether, diethylene glycol monobutyl ether, diethylene glycol dimethyl ether, propylene glycol monomethyl ether, propylene glycol monobutyl ether, ethylene glycol monomethyl ether acetate, triethylene glycol monomethyl ether, triethylene glycol monoethyl ether, triethylene glycol monobutyl ether, trienthylene glycol dimethyl ether, dipropylene glycol monopropyl ether, tripropylene glycol dimethyl ether, and the like), amines (for example, ethanolamine, diethanolamine, triethanolamine, N-methyl diethanolamine, N-ethyl diethanolamine, morpholine, N-ethyl morpholine, ethylenediamine, diethylenediamine, triethylenetetramine, tetraethylenepentamine, polyethyleneimine, pentamethyl diethylene triamine, tetramethyl propylene diamine, and the like), amides (for example, formamide, N, N-dimethylformamide, N,N-dimethylacetamide, and the like), heterocyclic compounds (for example, 2-pyrrolidone, N-methyl-2-pyrrolidone, N-cyclohexyl-2-pyrrolidone, 2-oxazolidone, 1,3-dimethyl-2-imidazolidinone, and the like), sulfoxides (for example, dimethyl sulfoxid, and the like), sulfones (for example, sulfolane, and the like), sulfonates (for example, 1-butane sulfonates sodium salt, and the like), carbamide, acetonitrile, acetone, and the like.

Examples of a surfactant, although not specifically limited, include: anionic surfactants such as dialkyl sulfosuccinic acid salts, alkylnaphthalenesulfonates, fatty acid salts, and the like; nonionic surfactants such as polyoxyethylene alkyl ethers, polyoxyethylene alkyl aryl ethers, acetylenic glycols, polyoxyethylene-polyoxypropylene block copolymers, and the like; and cationic surfactants such as alkylamine salts, quaternary ammonium salts, and the like. Anionic surfactants and nonionic surfactants in particular can be preferably used.

Moreover, in the present invention, the polymeric surfactant described above can be used. As a surfactant, use of an acetylene-based surfactant is preferable from the viewpoint of having favorable injection stability and providing an image with high concentration, favorable brilliance, and excellent uniformity. Examples of the surfactant, although not specifically limited as long as they are acetylene-based surfactants, include: acetylene glycols, acetylene alcohols, and the like. A more preferable surfactant is a surfactant containing an acetylene group and an alkylene oxide chain.

First, referring to FIG. 1, the configuration of the inkjet recorder according to the first embodiment of this example will be described in detail. The inkjet recorder 1 of the first embodiment is provided with: an image data processing part 2, an operation part 3, a temperature detection part 4, a paper size detection part 5, a conveyance speed calculation part 6, a storage part 7, and a head control part 8.

The image data processing part 2 converts various image data, for example, characters and images downloaded by way of data transmission from a personal computer or scan function provided in the inkjet recorder 1 into data for each line in a sub-scanning direction of the head part 10, that is, print data for each nozzle in the head part 10, and also determines whether or not the print data is identical image data or variable data (images of different types depending on different pages), and then outputs this print data to the head control part 8.

The operation part 3 is formed of an operation panel provided with, for example, touch keys and ten keys. The operation part 3 makes, through the operator's desired operation, various printing-related settings, such as paper size of paper used for printing (for example, paper of a size, such as A4 and B5, in conformance with Japanese Industrial Standards), the print copy quantity, one-side/both-side print mode, normal/high-definition mode, and so on. Then the operation part 3 outputs print condition information obtained by these settings to the paper size detection part 5, the conveyance speed calculation part 6, and the head control part 8.

The temperature detection part 4 detects the temperature of a head part 10 during driving, and then outputs head temperature information based on this detected temperature of the head part to the head control part 8.

The paper size detection part 5 detects a length, in the sub-scanning direction, of paper printed based on the print condition information outputted from the operation part 3, that is, a length of paper along the conveyance direction, and then outputs paper size information based on this detected length of paper to the head control part 8.

The conveyance speed calculation part 6 calculates the conveyance speed of paper used for printing based on the print condition information outputted from the operation part 3, and then outputs conveyance speed information based on this calculated conveyance speed to the head control part 8.

The storage part 7 is formed of, for example, a magnetic, optical recording medium or a semiconductor memory such as a ROM or RAM, and stores various data required for driving the inkjet recorder 1, such as various processing programs related to the driving of the inkjet recorder 1.

The head control part 8 is so formed as to include a continuous print time calculator 8*a*, a continuous non-discharge nozzle extracting section 8*b*, a continuous discharge nozzle determining section 8*c*, and an idle discharge controller 8*d*, and performs various controls related to ink discharge on each of the nozzles of the head part 10 driven during printing.

The continuous print time calculator 8*a*, based on the print condition information outputted from the operation part 3, the paper size information outputted from the paper size detection part 5, and the conveyance speed information outputted from the conveyance speed calculation part 6, calculates the continuous print time for printing, and then outputs continuous print time information based on this calculated continuous print time to the idle discharge controller 8*d*.

The continuous non-discharge nozzle extracting section 8*b*, based on the print data outputted from the image data processing part 2, extracts from among the nozzles of the head part 10 a non-discharge nozzle that is continuously in a non-discharge state. Then the continuous non-discharge nozzle extracting section 8*b* outputs information related to this extracted non-discharge nozzle as non-discharge nozzle information to the continuous discharge nozzle determining section 8*c* and the idle discharge controller 8*d*.

The continuous discharge nozzle determining section 8*c*, based on the print data outputted from the image data processing part 2 and the non-discharge nozzle information outputted from the continuous non-discharge nozzle extracting section 8*b*, determines the number of lines for which a nozzle adjacent to the non-discharge nozzle continuously performs discharge, and then outputs adjacent nozzle information based on a result of this determination to the idle discharge controller 8*d*.

The idle discharge controller 8*d*, based on the print condition information outputted from the operation part 3, the head temperature information outputted from the temperature detection part 4, the continuous print time information outputted from the continuous print time calculator 8*a*, the non-discharge nozzle information outputted from the continuous non-discharge nozzle extracting section 8*b*, and the adjacent nozzle information outputted from the continuous discharge nozzle determining section 8*c*, determines whether to perform idle discharge individually from each of the continuous discharge nozzle and the continuous non-discharge nozzle or from all the nozzles. Then the idle discharge controller 8*d* calculates timing for idle discharge based on a result of this determination, and outputs this calculated idle discharge timing information as a drive control signal to the head part 10.

If the continuous print time is 10 minutes or more, maintenance of the head part 10 is required, so that the idle discharge controller 8*d* outputs an alarm signal to, for example, the display part, the sounding part, via which the operator is urged to do maintenance on the head part 10.

Next, referring to FIGS. 2 to 4, processing operation of the aforementioned inkjet recorder 1 of the first embodiment will be described with detailed examples. Here, a printing method performed is one-side printing of an identical image, evaluation ink used is commercially available ink (IJ printer IPSiO (trademark) JetG717 RC-1K11 black, manufactured by RICOH COMPANY LTD.), an evaluation machine used is a commercially available head (inkjet head CB2, manufactured by TOSHIBA TEC CORPORATION, with a drive frequency of 4.8 kHz and 8 gray-scales (1 to 7 drops), and a nozzle diameter of 24.5 μm), and the reference temperature of the head part 10 is set at 35° C.

First, the operator causes print data on a desired print image to be received by outputting it from a personal computer or the like to the inkjet recorder 1 (ST1). The inkjet recorder 1 converts this received image data into print data for each nozzle of the head part 10 (ST2). At this point, the inkjet recorder 1 simultaneously determines whether the print data is identical image data or variable data.

Next, the inkjet recorder 1 determines whether or not the head temperature of the head part 10 detected by the temperature detection part 4 is 35° C. or more (ST3). At this point, if the detected temperature of the head part 10 is 35° C. or more (Yes in ST3), the inkjet recorder 1, based on print copy quantity information, paper size information, conveyance speed information, and the like, calculates continuous print time when the head part 10 is at 35° C. or more (ST4). Then the processing proceeds to process A (see FIG. 3). On the other hand, if the detected temperature of the head part 10 is less than 35° C. (No in ST3), the inkjet recorder 1, based on the print copy quantity information, the paper size information, the conveyance speed information, and the like, calculates continuous print time when the head part 10 is less than 35° C. (ST5). Then the processing proceeds to process B (see FIG. 4).

Hereinafter, processing operation following the processes A and B will be described, referring to FIGS. 3 and 4, respectively.

As shown in FIG. 3, following the calculation of the continuous print time in ST4 of FIG. 2 (process A), the inkjet recorder 1 first determines whether or not the calculated continuous print time is less than 1 minute (ST11). At this point, if the continuous print time is less than 1 minute (Yes in ST11), the inkjet recorder 1 next extracts a non-discharge nozzle in a non-discharge state continuously for 800 lines or more (ST12).

On the other hand, if the continuous print time is 1 minute or more in ST11 (No in ST11), the inkjet recorder 1 next determines whether or not the continuous print time is less than 5 minutes (ST16).

Following the extraction of the non-discharge nozzle in a non-discharge state continuously for 800 lines or more in ST12, the inkjet recorder 1 next determines whether or not a nozzle adjacent to the extracted non-discharge nozzle performs discharge continuously for 800 lines or more (ST13).

At this point, if the adjacent nozzle performs discharge continuously for 800 lines or more (Yes in ST13), to achieve idle discharge from the non-discharge nozzle once every 800 lines and from the adjacent nozzle once every 2000 lines, the inkjet recorder 1 outputs a drive control signal to the head part 10, whereby idle discharge is performed at the specified numbers of lines (ST14).

On the other hand, if the frequency of continuous discharge from the adjacent nozzle is less than 800 lines (No in ST13), to achieve idle discharge from all the nozzles once every 2000 lines, the inkjet recorder 1 outputs a drive control signal to the head part 10, whereby idle discharge is performed at the specified number of lines (ST15).

If the continuous print time is less than 5 minutes in ST16 (Yes in ST16), the inkjet recorder 1 next extracts a non-discharge nozzle in a non-discharge state continuously for 500 lines or more (ST17).

On the other hand, if the continuous print time is 5 minutes or more (No in ST16), the inkjet recorder 1 next determines whether or not the continuous print time is less than 10 minutes (ST21).

Following the extraction of the non-discharge nozzle in a non-discharge state continuously for 500 lines or more in ST17, the inkjet recorder 1 next determines whether or not a nozzle adjacent to the extracted non-discharge nozzle performs discharge continuously for 500 lines or more (ST18).

At this point, if the adjacent nozzle performs discharge continuously for 500 lines or more (Yes in ST18), to achieve idle discharge from the non-discharge nozzle once every 500 lines and from the adjacent nozzle once every 1000 lines, the inkjet recorder 1 outputs a drive control signal to the head part 10, whereby idle discharge is performed at the specified numbers of lines (ST19).

On the other hand, if the frequency of continuous discharge from the adjacent nozzle is less than 500 lines (No in ST18), to achieve idle discharge from all the nozzles once every 1000 lines, the inkjet recorder 1 outputs a drive control signal to the head part 10, whereby idle discharge is performed at the specified number of lines (ST20).

If the continuous print time is less than 10 minutes in ST21 (Yes in ST21), the inkjet recorder 1 next extracts a non-discharge nozzle in a non-discharge state continuously for 100 lines or more (ST22).

On the other hand, if the continuous print time is 10 minutes or more (No in ST21), the head part 10 requires maintenance, so that the inkjet recorder 1 outputs an alarm signal to, for example, the display part and the sounding part, via which the operator is urged to do maintenance on the head part 10 (ST26).

Following the extraction of the non-discharge nozzle in a non-discharge state continuously for 100 lines or more in ST22, the inkjet recorder 1 next determines whether or not a nozzle adjacent to the extracted non-discharge nozzle performs discharge continuously for 100 lines or more (ST23).

At this point, if the adjacent nozzle performs discharge continuously for 100 lines or more (Yes in ST23), to achieve idle discharge from the non-discharge nozzle once every 100 lines and from the adjacent nozzle once every 700 lines, the inkjet recorder 1 outputs a drive control signal to the head part 10, whereby idle discharge is performed at the specified numbers of lines (ST24).

On the other hand, if the frequency of continuous discharge from the adjacent nozzle is less than 100 lines (No in ST23), to achieve idle discharge from all the nozzles once every 700 lines, the inkjet recorder 1 outputs a drive control signal to the head part 10, whereby idle discharge is performed at the specified number of lines (ST25).

As shown in FIG. 4, following the calculation of the continuous print time in ST5 of FIG. 2 (process B), the inkjet recorder 1 first determines whether or not the calculated continuous print time is less than 1 minute (ST31) At this point, if the continuous print time is less than 1 minute (Yes in ST31), the inkjet recorder 1 next extracts a non-discharge nozzle in a non-discharge state continuously for 1000 lines or more (ST32).

On the other hand, if the continuous print time is 1 minute or more in ST31 (No in ST31), the inkjet recorder 1 next determines whether or not the continuous print time is less than 5 minutes (ST36).

Following the extraction of the non-discharge nozzle in a non-discharge state continuously for 1000 lines or more in ST 32, the inkjet recorder 1 next determines whether or not a nozzle adjacent to the extracted non-discharge nozzle performs discharge continuously for 1000 lines or more (ST33).

At this point, if the adjacent nozzle performs discharge continuously for 1000 lines or more (Yes in ST33), to achieve idle discharge from the non-discharge nozzle once every 1000 lines and from the adjacent nozzle once every 2000 lines, the inkjet recorder 1 outputs a drive control signal to the head part 10, whereby idle discharge is performed at the specified numbers of lines (ST34).

On the other hand, if the frequency of continuous discharge from the adjacent nozzle is less than 1000 lines (No in ST33), to achieve idle discharge from all the nozzles once every 2000 lines, the inkjet recorder 1 outputs a drive control signal to the head part 10, whereby idle discharge is performed at the specified number of lines (ST35).

If the continuous print time is less than 5 minutes in ST36 (Yes in ST36), the inkjet recorder 1 next extracts a non-discharge nozzle in a non-discharge state continuously for 800 lines (ST37).

On the other hand, if the continuous print time is 5 minutes or more (No in ST36), the inkjet recorder 1 next determines whether or not the continuous print time is less than 10 minutes (ST41).

Following extraction of the non-discharge nozzle in a non-discharge state continuously for 800 lines or more in ST37, the inkjet recorder 1 next determines whether or not a nozzle adjacent to the extracted non-discharge nozzle performs discharge continuously for 800 lines or more (ST38).

At this point, if the adjacent nozzle performs discharge continuously for 800 lines or more (Yes in ST38) to achieve idle discharge from the non-discharge nozzle once every 800 lines and from the adjacent nozzle once every 1500 lines, the inkjet recorder 1 outputs a drive control signal to the head part 10, whereby idle discharge is performed at the specified numbers of lines (ST39) On the other hand, if the frequency of continuous discharge from the adjacent nozzle is less than 800 lines (No in ST38), to achieve idle discharge from all the nozzles once every 1500 lines, the inkjet recorder 1 outputs a drive control signal to the head part 10, whereby idle discharge is performed at the specified number of lines (ST40).

If the continuous print time is less than 10 minutes in ST41 (Yes in ST41), the inkjet recorder 1 next extracts a non-discharge nozzle in a non-discharge sate continuously for 500 lines or more (ST42).

On the other hand, if the continuous print time is 10 minutes or more (No in ST41), the head part 10 requires maintenance, so that the inkjet recorder 1 outputs an alarm signal to, for example, the display part and the sounding part, via which the operator is urged to do maintenance on the head part 10 (ST46).

Following extraction of the non-discharge nozzle in a non-discharge state continuously for 500 lines or more in ST42, the inkjet recorder 1 next determines whether or not the nozzle adjacent to the extracted non-discharge nozzle performs discharge continuously for 500 lines or more (ST43).

At this point, if the adjacent nozzle performs discharge continuously for 500 lines or more (Yes in ST43), to achieve idle discharge from the non-discharge nozzle once every 500 lines and from the adjacent nozzle once every 1000 lines, the inkjet recorder 1 outputs a drive control signal to the head part 10, whereby idle discharge is performed at the specified numbers of lines (ST44).

On the other hand, if the frequency of continuous discharge from the adjacent nozzle is less than 500 lines (No in ST43), to achieve idle discharge from all the nozzles once every 1000 lines, the inkjet recorder 1 outputs a drive control signal to the head part 10, whereby idle discharge is performed at the specified number of lines (ST45).

Next, referring to FIG. 5, the second embodiment of the inkjet recorder 1 of this example will be described. The same components as those of the first embodiment are provided with the same numerals and omitted from the description. Only the components different from those of the first embodiment will be described.

As shown in FIG. 5, the inkjet recorder 1 of the second embodiment performs, as a control method for performing idle discharge control, idle discharge control in accordance with the head temperature and states of each of a continuous discharge nozzle and a continuous non-discharge nozzle. Thus, the inkjet recorder 1 of the second embodiment does not have the paper size detection part 5, conveyance speed calculation part 6, and continuous print time calculator 8*a* in the head control part 8 which are all provided in the inkjet recorder 1 of the first embodiment. The inkjet recorder 1 of the second embodiment performs control on idle discharge from each of the nozzles in the head part 10, based on print data from an image data processing part 2, print condition information from an operation part 3, and head temperature information from a temperature detection part 4.

Next, referring to FIG. 6, processing operation of the aforementioned inkjet recorder 1 of the second embodiment will be described, referring to a detailed example. Here, as is the case with the first embodiment, a printing method performed is one-side printing of an identical image, evaluation ink used is commercially available ink (IJ printer IPSiO (trade mark) JetG717 RC-1K11 black, manufactured by RICOH COMPANY LTD.), an evaluation machine used is a commercially available head (inkjet head CB2, manufactured by TOSHIBA TEC CORPORATION, with a drive frequency of 4.8 kHz and 8 gray-scales (1 to 7 drops), and a nozzle diameter of 24.5 μm), and the reference temperature of the head part 10 is set at 35° C.

First, the operator causes a desired print image to be received by outputting image data from a personal computer or the like to the inkjet recorder 1 (ST51). The inkjet recorder 1 converts this received image data into print data for each nozzle of the head part 10 (ST52) At this point in time, the inkjet recorder 1 simultaneously determines whether the print data is identical image data or variable data.

Next, the inkjet recorder 1 determines whether or not the head temperature of the head part 10 detected by the temperature detection part 4 is 35° C. or more (ST53). At this point, if the detected temperature of the head part 10 is 35° C. or more (Yes in ST53), the inkjet recorder 1 extracts a non-discharge nozzle in a non-discharge state continuously for 100 lines or more (ST54). On the other hand, if the detected temperature of the head part 10 is less than 35° C. (No in ST53), the inkjet recorder 1 extracts a non-discharge nozzle in a non-discharge state continuously for 1000 lines or more (ST58).

Following the extraction of the non-discharge nozzle in a non-discharge state continuously for 100 lines or more in ST54, the inkjet recorder 1 next determines whether or not a nozzle adjacent to the extracted non-discharge nozzle performs discharge continuously for 100 lines or more (ST55).

At this point, if the adjacent nozzle performs discharge continuously for 100 lines or more (Yes in ST55), to achieve idle discharge from the non-discharge nozzle once every 100 lines, the inkjet recorder 1 outputs a drive control signal to the head part 10, whereby idle discharge is performed at the specified number of lines (ST56).

On the other hand, if the frequency of continuous discharge from the adjacent nozzle is less than 100 lines (No in ST55), to achieve idle discharge from the non-discharge nozzle once every 700 lines, the inkjet recorder 1 outputs a drive control signal to the head part 10, whereby idle discharge is performed at the specified number of lines (ST57).

Following the extraction of the non-discharge nozzle in a non-discharge state continuously for 500 lines or more in ST58, the inkjet recorder 1 next determines whether or not a nozzle adjacent to the extracted non-discharge nozzle performs discharge continuously for 500 lines or more (ST59).

At this point, if the adjacent nozzle performs discharge continuously for 500 lines or more (Yes in ST59), to achieve idle discharge from the non-discharge nozzle once every 500 lines, the inkjet recorder 1 outputs a drive control signal to the head part 10, whereby idle discharge is performed at the specified number of lines (ST60)

On the other hand, if the frequency of continuous discharge from the adjacent nozzle is less than 500 lines (No in ST59), to achieve idle discharge from all the nozzles once every 1000 lines, the inkjet recorder 1 outputs a drive control signal to the head part 10, whereby idle discharge is performed at the specified number of lines (ST61).

In the inkjet recorder 1 of the second embodiment, if the continuous print time is 10 minutes or more, as is with the first embodiment, the head part 10 requires maintenance, so that the inkjet recorder 1 outputs an alarm signal to, for example, the display part and the sounding part, via which the operator is urged to do maintenance on the head part 10.

Conditions of the embodiments specified in the inkjet recorders 1 of the first and second embodiments are not limited to those mentioned above. The reference temperature, the frequency of idle discharge, and the like of the head part 10 are changed to optimum values as appropriate in accordance with, for example, the type of ink used, the diameter of nozzles in the head part 10, component configuration of the head part 10 and the inkjet recorder 1, types of an image to be printed and paper. Further, the inkjet recorders 1 of the first and second embodiments, upon selection of print condition such as one-side/both-side print modes, normal/high-definition modes, and the like in the operation part 3, outputs, from the operation part 3 to the idle discharge controller 8*d*, mode change information indicating that the mode has been changed, thereby optimally controlling the frequency of idle discharge in accordance with this mode change information outputted.

Hereinafter, the invention will be described further in detail, referring to Examples. The examples shown below do not limit the invention, and any design change in view of the points described above and below is included in the technical range of the invention.

EXAMPLE 1

In Example 1, the inkjet recorder 1 of the first embodiment was used. Basic condition is as follows. A print mode executed is a normal mode, a printing method performed is one-side printing of the same image, evaluation ink used is commercially available ink (IJ printer IPSiO (trade mark) JetG717 RC-1K11 black, manufactured by RICOH COMPANY LTD.), an evaluation machine used is a commercially available head (inkjet head CB2, manufactured by TOSHIBA TEC CORPORATION, with a drive frequency of 4.8 kHz and 8 gray-scales (1 to 7 drops), and a nozzle diameter of 24.5 μm), and the reference temperature of the head part 10 is set at 35° C. A table in FIG. 7 shows a relationship between the continuous print time and the frequency of idle discharge when the inkjet recorder 1 is driven in accordance with the condition described above.

EXAMPLE 2

Example 2 is an example in which the same inkjet recorder 1 as is used in Example 1 is used and the print mode is changed from the normal mode to the high-definition mode. A table in FIG. 8 shows a relationship between the continuous print time and the frequency of idle discharge when the inkjet recorder 1 is driven in accordance with the condition described above.

As described above, the aforementioned inkjet recorder 1, based on print data, selects a non-discharge nozzle that does not perform discharge continuously for a predetermined number of lines during printing and an adjacent nozzle that is adjacent to this non-discharge nozzle and that performs discharge continuously for a predetermined number of lines during printing, and regularly performs idle discharge from a non-discharge nozzle and a discharge nozzle selected based on the continuous print time calculated from the head temperature of the head part 10, the print copy quantity and size of paper used in printing, and the paper conveyance speed.

This consequently permits preventing discharge failure caused by quality change of ink slightly discharged by driving of the nozzle adjacent to the non-discharge nozzle and drying over the non-discharge time, and also permits minimizing the ink consumption while controlling unnecessary idle discharge. Thus, an economical inkjet recorder 1 can be provided which is capable of constantly performing stable printing.

The preferred embodiments of the invention have been described above, although the description of these embodiments and the accompanying drawings do not limit the invention. That is, needless to say, other embodiments, examples, applied technology, and the like achieved by those skilled in the art based on these embodiments are all included in the scope of the invention.

What is claimed is:

1. A line-type inkjet recorder for printing a desired image onto paper by discharging ink from a plurality of nozzles provided in a head part, the inkjet recorder comprising:

an image data processing part for converting image data to be printed into print data for each of the nozzles;

an operation part for setting desired printing-related image data to input print condition information;

a temperature detection part for detecting a temperature of the head part and outputting head temperature information based on the detected temperature;

a paper size detection part for detecting a length of the paper in a sub-scanning direction and outputting detected paper size information based on the detected length of the paper;

a conveyance speed calculation part for calculating a conveyance speed of the paper based on the print condition information outputted from the operation part and outputting conveyance speed information based on the calculated conveyance speed; and a head control part for, based on states of a continuous non-discharge nozzle and a continuous discharge nozzle adjacent thereto included in the nozzles and extracted based on the print condition information from the operation part, the paper size information from the paper size detection part, continuous print time information obtained from the conveyance speed information from the conveyance speed calculation part, the head temperature information from the temperature detection part, and the print data from the image data processing part, controlling frequencies of idle discharge from the continuous non-discharge nozzle and continuous discharge nozzle extracted.

* * * * *